US011287841B2

(12) United States Patent
Koike et al.

(10) Patent No.: US 11,287,841 B2
(45) Date of Patent: Mar. 29, 2022

(54) OPERATING DEVICE AND CONTROL METHOD FOR OPERATING DEVICE

(71) Applicant: Alps Alpine Co., Ltd., Tokyo (JP)

(72) Inventors: Asuka Koike, Miyagi-ken (JP); Kazunari Takahashi, Miyagi-ken (JP); Misuzu Takahashi, Miyagi-ken (JP); Atsushi Goto, Miyagi-ken (JP); Ryuichiro Yasuhara, Miyagi-ken (JP)

(73) Assignee: Alps Alpine Co., Ltd.

( * ) Notice: Subject to any disclaimer, the term of this patent is extended or adjusted under 35 U.S.C. 154(b) by 0 days.

(21) Appl. No.: 17/184,765

(22) Filed: Feb. 25, 2021

(65) Prior Publication Data

US 2021/0181781 A1 Jun. 17, 2021

Related U.S. Application Data

(63) Continuation of application No. PCT/JP2019/012098, filed on Mar. 22, 2019.

(30) Foreign Application Priority Data

Aug. 30, 2018 (JP) ..... JP2018-161169

(51) Int. Cl.
*G05G 5/03* (2008.04)
*G05G 1/10* (2006.01)

(52) U.S. Cl.
CPC ..... *G05G 5/03* (2013.01); *G05G 1/10* (2013.01); *G05G 2505/00* (2013.01)

(58) Field of Classification Search
CPC ..... G05G 2505/00
See application file for complete search history.

(56) References Cited

U.S. PATENT DOCUMENTS 6,854,573 B2 * 2/2005 Jolly ..... F16D 57/002 188/161
2011/0128135 A1 * 6/2011 Periquet ..... B60K 37/06 340/407.2
2016/0378131 A1 12/2016 Battlogg

FOREIGN PATENT DOCUMENTS

JP 2005-507061 A 3/2005
JP 2008-309253 A 12/2008
JP 2017-173951 A 9/2017
WO 2003-036120 A2 5/2003

* cited by examiner

*Primary Examiner* — Vicky A Johnson
(74) *Attorney, Agent, or Firm* — Harness, Dickey & Pierce, P.L.C.

(57) ABSTRACT

An operating device according to the present invention includes magnetic field generation means. The magnetic field generation means includes a coil generating a magnetic field when energized, and a yoke forming a magnetic path for the magnetic field passing through a rotor. A control unit includes magnetization means and rotational torque control means. The magnetization means supplies a current to energize the coil such that a residual magnetic field in the yoke is held at a predetermined magnitude. The rotational torque control means adjusts a current value applied to the coil in accordance with the magnitude of the residual magnetic field in the yoke. An absolute value of a maximum value of the current value applied to the coil by the rotational torque control means is smaller than an absolute value of a current value applied by the magnetization means.

5 Claims, 15 Drawing Sheets

OPERATING DEVICE AND CONTROL METHOD FOR OPERATING DEVICE

CLAIM OF PRIORITY

This application is a Continuation of International Application No. PCT/JP2019/012098 filed on Mar. 22, 2019, which claims benefit of Japanese Patent Application No. 2018-161169 filed on Aug. 30, 2018. The entire contents of each application noted above are hereby incorporated by reference.

BACKGROUND OF THE INVENTION

1. Field of the Invention

The present invention relates to an operating device capable of changing rotational resistance with use of a magneto-rheological fluid and to a control method for the operating device.

2. Description of the Related Art

A brake disclosed in International Publication WO 03/036120 A2 includes a rotor, a shaft connected to the rotor to be capable of suppressing relative rotation between the shaft and the rotor, a housing including first and second housing chambers, and a controllable material in contact with at least a working portion of the rotor. The rotor is rotatably accommodated in the first housing chamber, and a magnetic field generator and an electronic device are placed in the second housing chamber. The electronic device includes a sensor for detecting a relative rotational position of the rotor and controls the magnetic field generator to apply a magnetic field of which intensity is determined in accordance with the relative rotational position of the rotor.

In the brake disclosed in International Publication WO 03/036120 A2, the relative rotation between the shaft and the rotor is detected by the above-mentioned sensor, and a current applied to the coil of the magnetic field generator is controlled in accordance with a detection result. When an application current is changed to provide a strong brake force, there is almost no problem. However, when an operation feel is to be controlled while a weak brake force is applied, there is a problem that a variation in torque when the coil is not energized (namely, an initial torque) makes a driver feel uncomfortable in the operation. Although feedback control using a magnetic sensor added to measure a magnetic field is conceivable to suppress the variation in the initial torque, such feedback control requires a complicated control circuit and extra work of, for example, attaching the magnetic sensor at an appropriate position and laying wirings for the magnetic sensor. This may lead to a possibility of not also increasing the costs of parts and manufacturing, but also causing restrictions on layout of constituent members.

SUMMARY OF THE INVENTION

The present invention provides an operating device utilizing a magneto-rheological fluid and enabling a desired constant initial torque to be obtained while suppressing the cost related to control, and further provides a control method for the operating device.

The present invention provides an operating device including an operating member supported to be rotatable, a rotor rotating together with the operating member, magnetic field generation means configured to generate a magnetic field passing through the rotor, a magneto-rheological fluid disposed in contact with the rotor and giving a resistance force to rotation by action of the magnetic field passing through the rotor, and a control unit configured to control the magnetic field generation means, the magnetic field generation means including a coil generating the magnetic field when energized and a yoke forming a magnetic path for the magnetic field passing through the rotor, the control unit including magnetization means and rotational torque control means, the magnetization means supplying a current to energize the coil such that a residual magnetic field in the yoke is held at a predetermined magnitude, the rotational torque control means adjusting a current value applied to the coil in accordance with the magnitude of the residual magnetic field in the yoke while setting an absolute value of a maximum value of the current value applied to the coil by the rotational torque control means to be smaller than an absolute value of a current value applied by the magnetization means.

With the above-described feature, since there is no necessity of disposing a magnetic sensor and performing feedback control, the cost related to control can be reduced. Furthermore, since the magnetization means supplies a current to energize the coil such that the residual magnetic field in the yoke is held at the predetermined magnitude and the rotational torque control means sets the absolute value of the maximum value of the current value applied to the coil by the rotational torque control means to be smaller than the absolute value of the current value applied by the magnetization means, a desired constant initial torque based on a hysteresis characteristic specific to a material used for the yoke can be obtained. As a result, an operation feel can be stably controlled.

In the operating device according to the present invention, preferably, the magnetization means sets, as the predetermined magnitude, a magnitude of saturated residual magnetization by energizing the coil and bringing the yoke into a saturated state.

By setting the predetermined magnitude as described above, the residual magnetic field can be specified to a numerical value specific to the material used for the yoke. As a result, the desired constant initial torque can be easily and reliably obtained.

In the operating device according to the present invention, preferably, the control unit controls the magnetization means to execute energization of the coil when the operating device is started up.

With the above-described feature, since the yoke can be set into a state of predetermined magnetization and residual magnetic flux passing through the rotor can be set to a predetermined value before a user performs an operation, the initial torque can be stably set to a constant value.

In the operating device according to the present invention, preferably, the rotational torque control means controls a minimum torque to come close to zero by setting the current value applied to the coil with an offset such that magnetic flux passing through the rotor becomes zero.

With the above-described feature, even when the initial torque based on the residual magnetic field in the yoke is large, a resistance force perceived by the user can be suppressed and operability can be increased.

The present invention further provides a control method for an operating device including an operating member supported to be rotatable, a rotor rotating together with the operating member, magnetic field generation means configured to generate a magnetic field passing through the rotor, and a magneto-rheological fluid disposed in contact with the rotor and giving a resistance force to rotation by action of the magnetic field passing through the rotor, the magnetic field generation means including a coil generating the magnetic field when energized and a yoke forming a magnetic path for the magnetic field passing through the rotor, the control method including a magnetization step of supplying a current to energize the coil such that a residual magnetic field in the yoke is held at a predetermined magnitude, and a rotational torque control step of adjusting a current value applied to the coil in accordance with the magnitude of the residual magnetic field in the yoke while setting an absolute value of a maximum value of the current value applied to the coil in the rotational torque control step to be smaller than an absolute value of a current value applied in the magnetization step.

With the above-described feature, since there is no necessity of disposing a magnetic sensor and performing feedback control, the cost related to control can be reduced. Furthermore, since the magnetization means supplies a current to energize the coil such that the residual magnetic field in the yoke is held at the predetermined magnitude, a desired constant initial torque can be obtained based on a hysteresis curve specific to a material used for the yoke.

DESCRIPTION OF THE PREFERRED EMBODIMENTS

Basic Form

A basic form of an operating device according to an embodiment will be described with reference to the drawings. In the basic form, a magnetic disk 120 is described as having the shape of a substantially circular plate with an upper surface 124 and a lower surface 125 being both flat. The shape of a magnetic disk 170 (FIG. 7) in a specific embodiment will be described later.

Figure 1A:
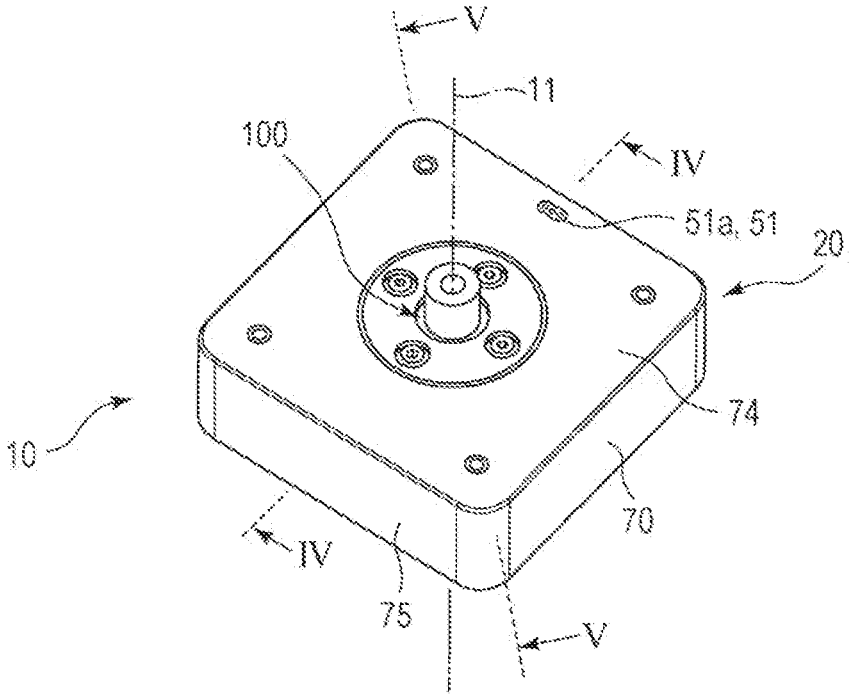
FIG. 1A is a perspective view when looking at a basic form of an operating device from above.
Figure 1B:
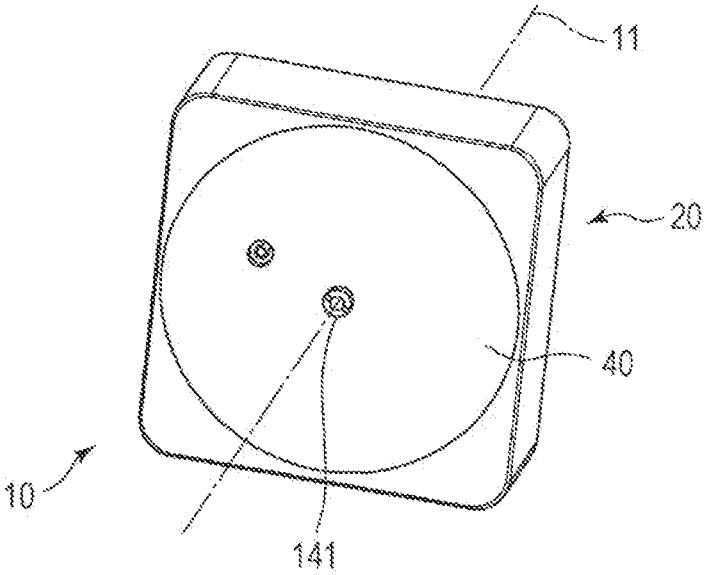
FIG. 1B is a perspective view when looking at the operating device of FIG. 1A from below.
Figure 2:
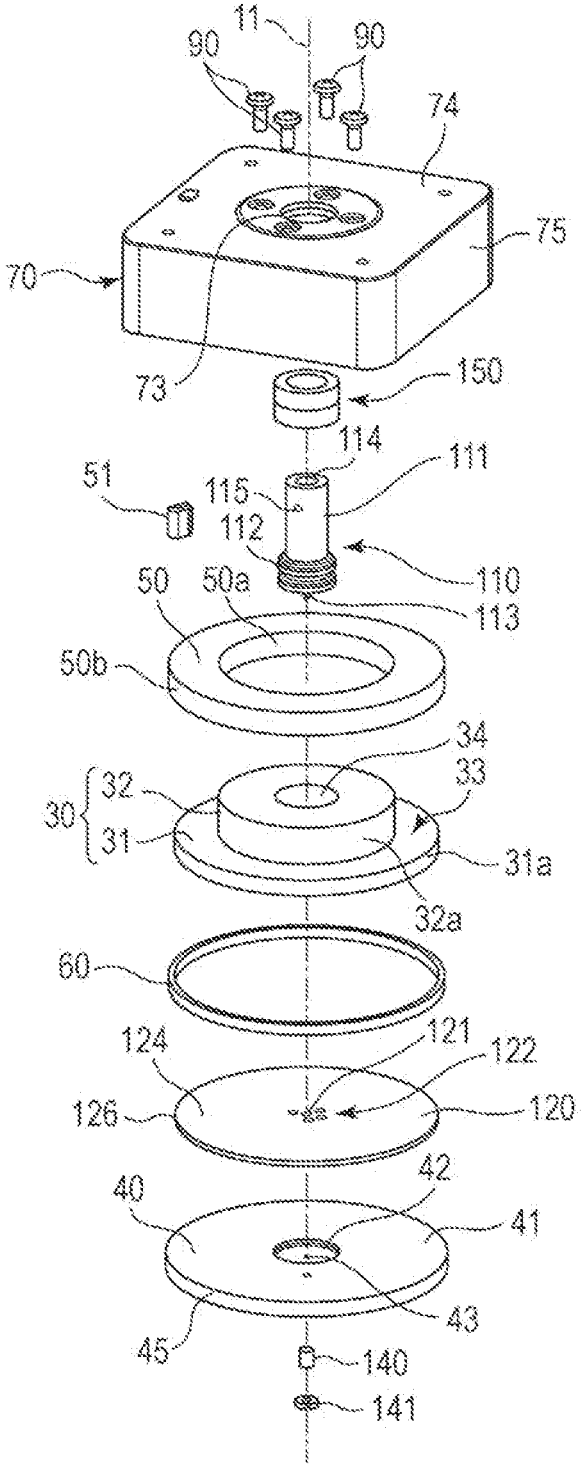
FIG. 2 is an exploded perspective view when looking at the operating device illustrated in FIGS. 1A and 1B from above.
Figure 3:
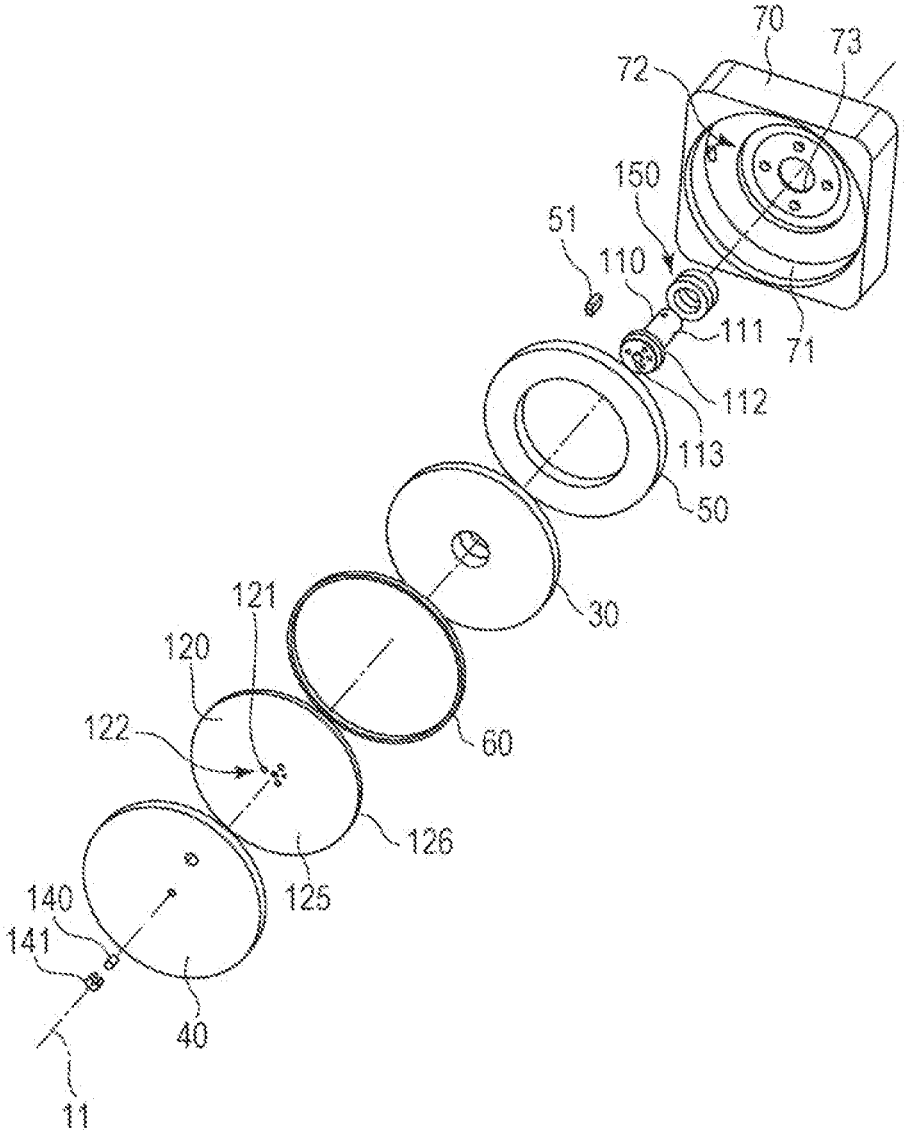
FIG. 3 is an exploded perspective view when looking at the operating device illustrated in FIGS. 1A and 1B from below.
Figure 4A:
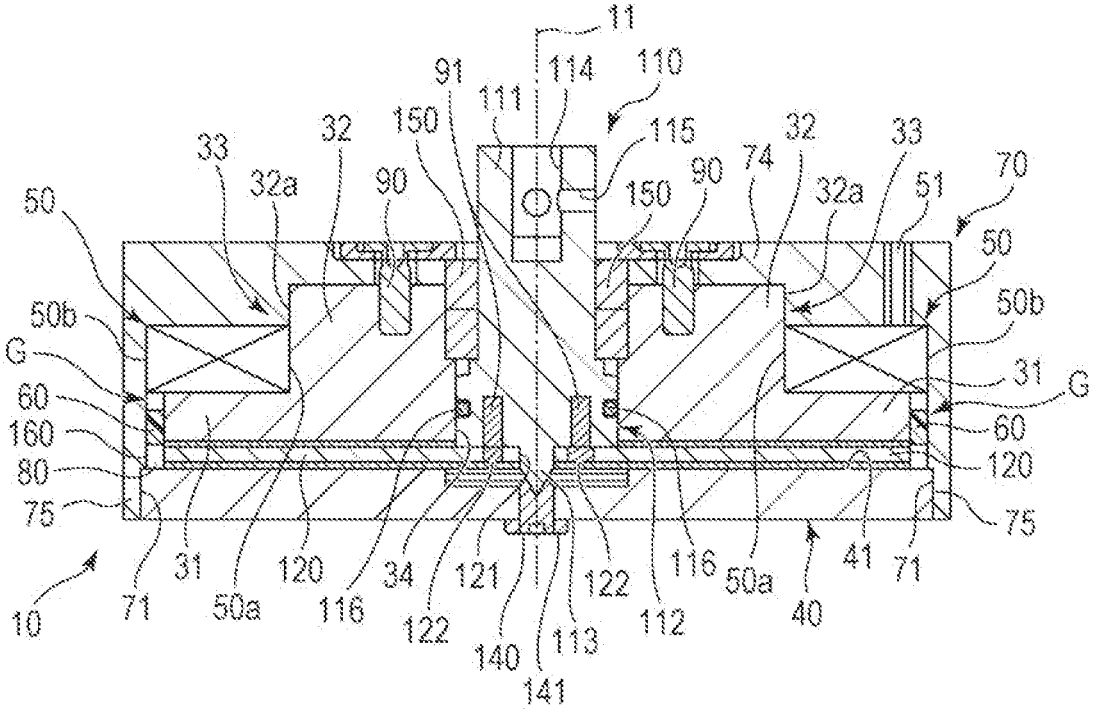
FIGS. 4A and 4B are sectional views taken along a line IV-IV in FIG. 1A; specifically, FIG. 4B conceptually represents a magnetic field generated by an excitation coil.
Figure 4B:
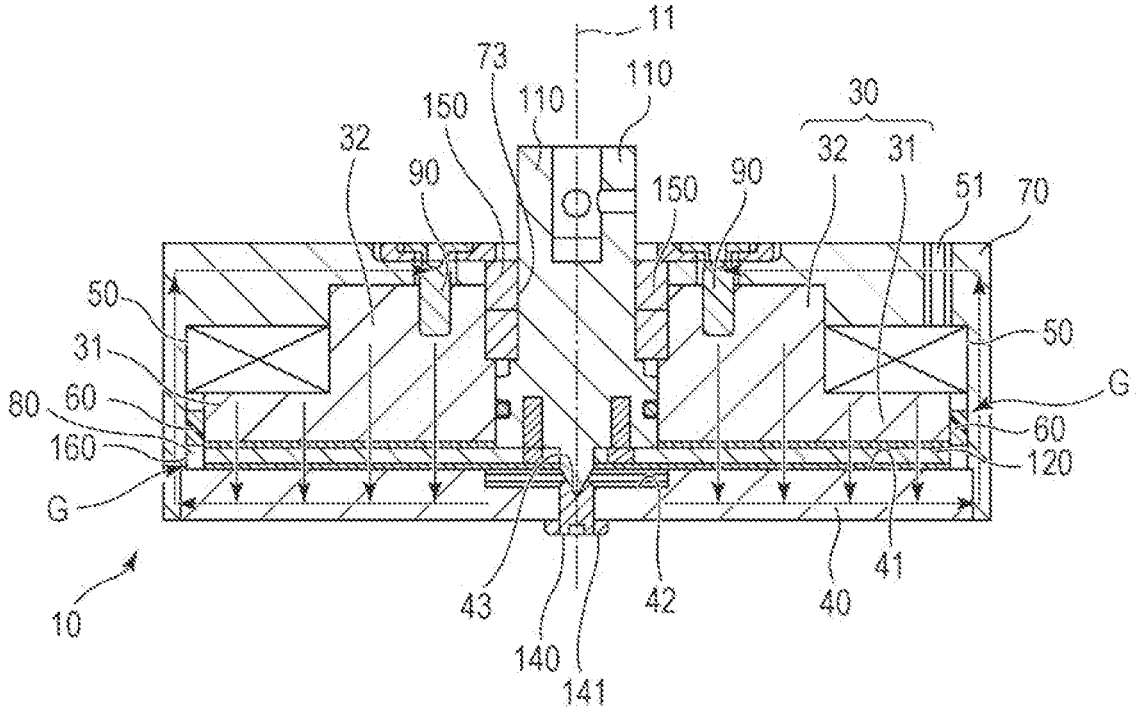
Figure 5A:
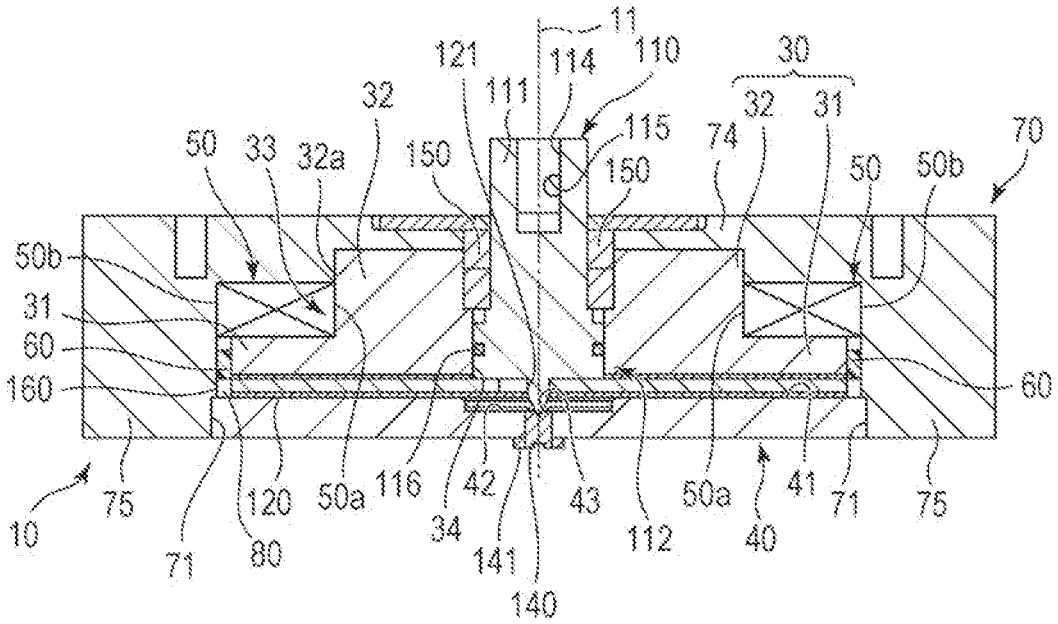
FIGS. 5A and 5B are sectional views taken along a line V-V in FIG. 1A; specifically, FIG. 5B conceptually represents a magnetic field generated by the excitation coil.
Figure 5B:
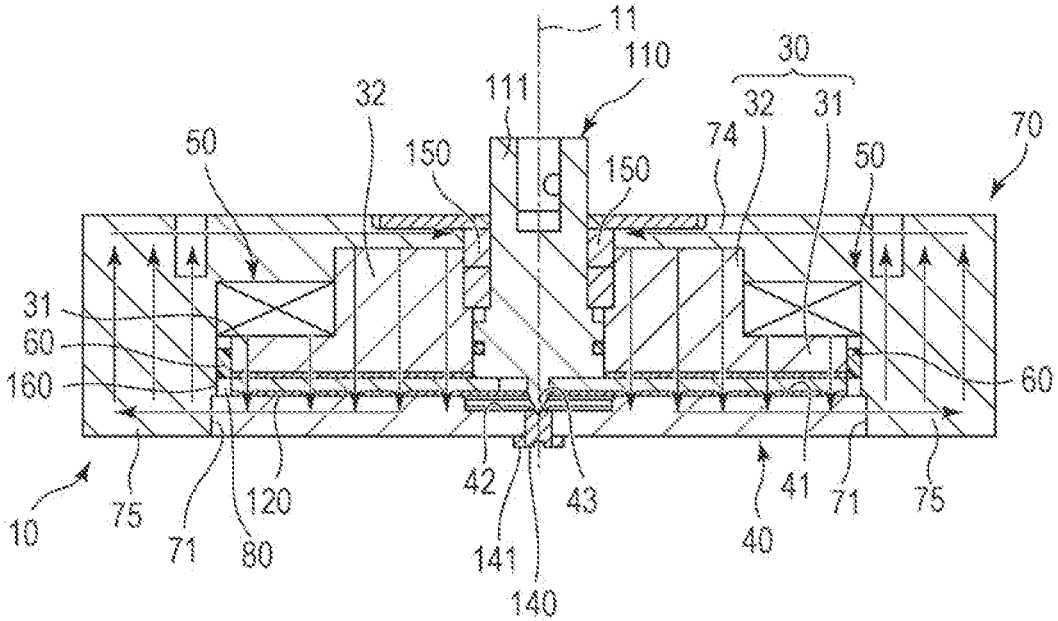
Figure 6:
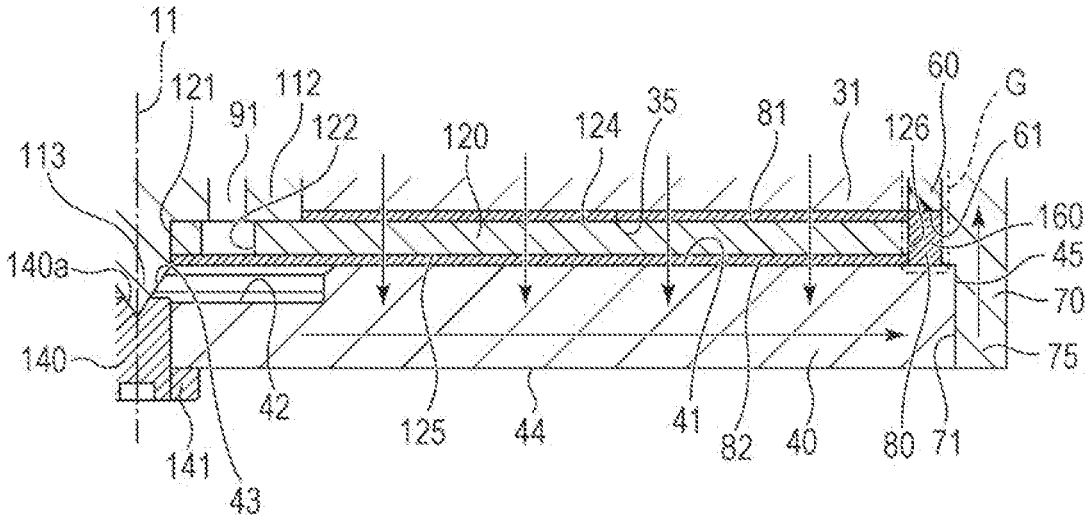
FIG. 6 is a partial enlarged view of FIG. 4A.

FIG. 1A is a perspective view when looking at an operating device 10 in the basic form from above, and FIG. 1B is a perspective view when looking at the operating device 10 from below. FIGS. 2 and 3 are each an exploded perspective view of the operating device 10. FIG. 2 is the exploded perspective view when viewed from above, and FIG. 3 is the exploded perspective view when viewed from below. FIGS. 4A and 4B are sectional views taken along a line IV-IV in FIG. 1A; specifically, FIG. 4B is an explanatory view conceptually representing a magnetic field generated by an excitation coil 50. FIGS. 5A and 5B are sectional views taken along a line V-V in FIG. 1A; specifically, FIG. 5B conceptually represents a magnetic field generated by the excitation coil 50. FIG. 6 is a partial enlarged view of FIG. 4A.

In FIGS. 1A to 6, for convenience of explanation, an up-down direction is defined as a direction along a center axis 11. However, such a definition is not intended to restrict a direction adopted in practical use. The direction along the center axis 11 is called a first direction, and a radial direction extending from the center axis 11 perpendicularly to the center axis 11 is called a second direction in some cases. In the following direction, the wording "plan view" is also used as representing a state when looking at a lower side from an upper side along the center axis 11. In FIGS. 2 and 3, some of screws and a magneto-rheological fluid are omitted.

As illustrated in FIGS. 1A and 1B, the operating device 10 includes a holder 20 and an operating unit 100. The operating unit 100 includes a shaft 110 serving as an operating member and the magnetic disk 120 (rotor) rotating together with the shaft 110. The operating unit 100 is supported by the holder 20 to be rotatable in opposite directions about the center axis 11 (rotation axis). The operating unit 100 is supported by the holder 20 in a rotatable state with the aid of a support member 140 and a radial bearing 150 (FIG. 2). Furthermore, as illustrated in FIGS. 4 to 6, a magneto-rheological fluid (MRF) 160 is filled in a gap 80 defined within the operating device 10.

The holder 20 includes a first yoke 30, a second yoke 40, the excitation coil 50, an annular member 60, and a third yoke 70 serving also as an upper case. The first yoke 30, the second yoke 40, and the third yoke 70 are separately processed and formed. Instead, any two or more of the first yoke 30, the second yoke 40, and the third yoke 70 may be combined and formed integrally with each other.

As illustrated in FIG. 2, the first yoke 30 includes a circular ring portion 31 and a cylindrical portion 32 that is formed integrally with the circular ring portion 31 and that extends upward from an upper surface of the circular ring portion 31 in concentrical relation to the circular ring portion 31. Each of the circular ring portion 31 and the cylindrical portion 32 has a circular shape with the center axis 11 being a center when viewed in plan, and an outer diameter of the cylindrical portion 32 is smaller than that of the circular ring portion 31. With the difference in outer diameter between the circular ring portion 31 and the cylindrical portion 32, a stepped portion 33 is formed on an outer side of an outer peripheral surface 32*a* of the cylindrical portion 32. Furthermore, the first yoke 30 has an inner peripheral surface 34 of a circular shape with the center axis 11 being center when viewed in plan. The inner peripheral surface 34 penetrates through the circular ring portion 31 and the cylindrical portion 32 along the center axis 11, and an inner diameter of the inner peripheral surface 34 is set to change depending on a position in the up-down direction.

As illustrated in FIG. 4A, the excitation coil 50 serving as a magnetic field generator is disposed on the stepped portion 33 of the first yoke 30. The excitation coil 50 has an annular shape with an inner periphery 50*a* following the outer peripheral surface 32*a* of the cylindrical portion 32, and an outer periphery 50*b* of the excitation coil 50 is positioned on an outer side with respect to the outer peripheral surface 31*a* of the circular ring portion 31 in a radial direction. Thus, the excitation coil 50 overlaps with an outward-extending part of the circular ring portion 31 when viewed in plan. The excitation coil 50 is a coil including conductive wires that are wound into a coiled shape around the center axis 11. A connection member 51 is electrically connected to the excitation coil 50, and a current is supplied to an input portion 51*a* of the connection member 51 through a not-illustrated path, the input portion 51*a* being exposed to the outside from an upper surface of the third yoke 70. When the current is supplied to the excitation coil 50, the excitation coil 50 generates a magnetic field.

The annular member 60 is fixed to the circular ring portion 31 of the first yoke 30 along the outer peripheral surface 31*a* thereof. The annular member 60 has a circular ring shape and is made of a nonmagnetic material such as synthetic resin. The annular member 60 in a state fixed to the first yoke 30 has, when viewed in plan, a circular shape with substantially the same outer diameter as that of the excitation coil 50 disposed on the stepped portion 33. As illustrated in FIG. 6, a lower surface 61 of the annular member 60 forms a plane that is substantially flush with a bottom surface 35 of the first yoke 30, the plane extending along a direction perpendicular to the center axis 11. A thickness of the annular member 60 in the radial direction is set to be able to prevent the magnetic field generated by the excitation coil 50 from passing through the annular member 60 in the radial direction. The thickness of the annular member 60 in the radial direction may change at different vertical positions.

As illustrated in FIG. 2, the second yoke 40 has the shape of a circular plate and is disposed under the first yoke 30. The second yoke 40 has an upper surface 41 perpendicular to the up-down direction along the center axis 11. An annular groove 42 opened upward while surrounding the center axis 11 is formed in the upper surface 41. A hole 43 penetrating through the second yoke 40 in the up-down direction is formed at a center of the groove 42. As illustrated in FIG. 6, a support member (pivot support member) 140 extending in the up-down direction is inserted into the hole 43, and the support member 140 is fixed to the second yoke 40 by a retainer 141 that is fixed to a lower surface 44 of the second yoke 40. The support member 140 includes a receiving portion 140*a* in the form of a recess opened upward, and the receiving portion 140*a* rotatably supports a tip end 113 of the shaft 110.

The yokes 30 and 40 are each not always required to have a circular shape in a plan view. A combination of two divided yokes may not need to be the above-described combination of the first yoke 30 and the second yoke 40, and each of the divided yokes may have a rectangular shape in a plan view depending on a division position.

As illustrated in FIG. 6, the bottom surface 35 of the first yoke 30 and the lower surface 61 of the annular member 60 are substantially parallel to the upper surface 41 of the second yoke 40, and the gap 80 is formed between the bottom surface 35 and the upper surface 41.

As illustrated in FIG. 3, the third yoke 70 has a space 72 accommodating (1) the excitation coil 50, the first yoke 30, and the annular member 60, (2) the connection member 51, and (3) the radial bearing 150, the shaft 110, and the magnetic disk 120. The space 72 is formed in a circular shape by an inner peripheral surface 71 of the third yoke 70 when viewed in plan and is closed at a lower side by the second yoke 40 that is arranged in place. The space 72 is surrounded by an upper wall 74 and a sidewall 75 of the third yoke 70. The third yoke 70 is substantially rectangular when viewed in plan as illustrated in FIGS. 1A and 1B, while the space 72 is circular when viewed in plan as mentioned above. Hence the shape of the sidewall 75 in a plan view, namely the shape of the sidewall 75 defining an outer surface of the third yoke 70, is thick in corner portions of the third yoke 70 and is thin in portions along sides thereof.

The second yoke 40 is fixed to the third yoke 70 by screws (not illustrated) penetrating through the sidewall 75 of the third yoke 70 in the radial direction. Thus, the outer peripheral surface 45 of the second yoke 40 is fixedly held in contact with the sidewall 75 of the third yoke 70, whereby the second yoke 40 and the third yoke 70 are magnetically connected to each other (see FIG. 6). The second yoke 40 and the third yoke 70 may be fixed to each other by other means, such as welding, instead of screws.

A magnetic path (magnetic circuit) in which the magnetic field generated by the excitation coil 50 defines a closed loop can be formed by using the first yoke 30, the second yoke 40, and the third yoke 70.

Here, the first yoke 30, the second yoke 40, the third yoke 70, and the excitation coil 50 constitute magnetic field generation means configured to generate a magnetic field passing through the magnetic disk 120, namely the rotor.

As illustrated in FIGS. 4A and 4B, the third yoke 70 and the first yoke 30 are fixed to each other by multiple screws 90 vertically penetrating through the upper wall 74 of the third yoke 70. Thus, an upper portion of the first yoke 30 and the upper wall 74 of the third yoke 70 are fixedly held in contact state, whereby the first yoke 30 and the third yoke 70 are magnetically connected to each other in a contact region.

On the other hand, the annular member 60 made of the nonmagnetic material is fixed to the outer peripheral surface 31*a* of the circular ring portion 31 of the first yoke 30, and an outer peripheral surface of the annular member 60 is held in contact with the inner peripheral surface 71 of the third yoke 70. Accordingly, the circular ring portion 31 of the first yoke 30 and the sidewall 75 of the third yoke 70 are apart from each other by the presence of the annular member 60 in the direction perpendicular to the center axis 11, and a magnetic gap G is formed therebetween. When viewed in the first direction along the center axis 11, the magnetic gap G extends from a bottom surface of the excitation coil 50 to the upper surface 41 of the second yoke 40.

Furthermore, when viewed in the second direction defined as the radial direction, the magnetic gap G corresponds to a gap between an outer peripheral edge 126 of the magnetic disk 120, which is disposed in the gap 80 between the first yoke 30 and the second yoke 40, and the inner peripheral surface 71 of the third yoke 70. With the provision of the magnetic gap G, magnetic flux of the magnetic field generated by the excitation coil 50 can be suppressed from passing, in the direction perpendicular to the center axis 11, from the circular ring portion 31 of the first yoke 30 to the sidewall 75 of the third yoke 70 and from the magnetic disk 120 to the sidewall 75 of the third yoke 70. Part of the third yoke 70 is formed as a region that is positioned close to the magnetic disk 120 on an outer side of the magnetic disk 120 and the excitation coil 50 with interposition of the magnetic gap G.

In the above-described structure, when a current is applied to the excitation coil 50, a magnetic field flowing in a direction schematically denoted by arrows in FIG. 4B is formed. Furthermore, when a current in a direction opposite to that in the above case is applied to the excitation coil 50, a magnetic field flowing in a direction opposite to that denoted in FIG. 4B is formed. In an example illustrated in FIG. 4B, magnetic flux crosses the magnetic disk 120 along the direction of the center axis 11 from the first yoke 30 toward the second yoke 40. Then, the magnetic flux advances in the second yoke 40 in a direction away from the center axis 11 and further advances in the sidewall 75 of the third yoke 70 upward from below along the direction of the center axis 11.

Moreover, the magnetic flux advances, in the upper wall 74 of the third yoke 70, in a direction toward the center axis 11 and further advances, in a region of the upper wall 74 corresponding to an inner side of the excitation coil 50, downward from above, namely toward the cylindrical portion 32 of the first yoke 30. In the inner side of the excitation coil 50, the magnetic flux advances downward, crosses the magnetic disk 120, and reaches the second yoke 40 again.

In the magnetic field having the above-described magnetic path, because the magnetic gap G is formed, the magnetic flux is restricted from passing from the circular ring portion 31 and the magnetic disk 120 to the sidewall 75 of the third yoke 70. Furthermore, because the second yoke 40 and the sidewall 75 of the third yoke 70 are magnetically connected to each other, the magnetic path passing from the second yoke 40 to the sidewall 75 is secured. In addition, because, as described above, the shape of the sidewall 75 in a plan view is thick in the corner portions of the third yoke 70 and is thin in the portions along the sides thereof, a wide magnetic path can be secured especially in part of the sidewall 75 corresponding to each of the corner portions, and the magnetic field can be reliably formed along such a magnetic path (see FIG. 5B). Although the third yoke 70 is substantially rectangular when viewed in plan in an example described here, the third yoke 70 may have any other suitable shape such as a circular shape when viewed in plan on condition that a satisfactory magnetic path is secured.

The third yoke 70 has a substantially cylindrical through-hole 73 formed in a region including the center axis 11. The through-hole 73 penetrates through the third yoke 70 in the up-down direction. A space in the through-hole 73 is communicated, in the up-down direction, with a space surrounded by the inner peripheral surface 34 of the first yoke 30.

A structure of the operating unit 100 will be described below.

As illustrated in FIGS. 2 and 3, the shaft 110 is a rod-shaped member vertically extending along the center axis 11, and it includes an upper shaft portion 111 and a grooved portion 112 provided on a lower side of the shaft portion 111. The grooved portion 112 includes a groove formed in an outer peripheral surface with the center axis 11 being a center. The tip end 113 provided at a center of a lower surface of the grooved portion 112 has a shape tapering downward.

As illustrated in FIG. 3, the magnetic disk 120, namely the rotor, is a member in the form of a circular plate made of a magnetic material and having a circular flat surface that is arranged perpendicular to the up-down direction. A center hole 121 vertically penetrating through the magnetic disk 120 is formed at a center of the circular flat surface of the magnetic disk 120, and multiple through-holes 122 vertically penetrating through the magnetic disk 120 are formed at positions around the center hole 121. The magnetic disk 120 is fixed to the shaft 110 by fitting shaft portions of screws 91, which have been inserted through the through-holes 122, into the grooved portion 112 of the shaft 110 from below. Thus, the magnetic disk 120 is held to be rotatable together with the shaft 110 serving as the operating member.

The shape of the rotor is not limited to the circular plate like the magnetic disk 120. The rotor may have any suitable shape other than the circular plate insofar as the rotor is rotated together with the shaft 110 and is given with a resistance force generated by the magneto-rheological fluid 160.

As illustrated in FIGS. 4A and 4B, the shaft portion 111 of the shaft 110 is rotatably supported by the radial bearing 150, and the tip end 113 of the shaft 110 at a lower end of the grooved portion 112 passes through the center hole 121 of the magnetic disk 120 and is pivotally supported by the support member (pivot support member) 140. The radial bearing 150 is supported by the third yoke 70 and the first yoke 30 at a predetermined position in the up-down direction. An O-ring 116 is fitted into the groove of the grooved portion 112. Thus, the shaft 110 is supported to be rotatable about the center axis 11 relative to the first yoke 30, the second yoke 40, and the third yoke 70 while maintaining close contact with the first yoke 30. An upper part of the shaft portion 111 is exposed upward from the third yoke 70 and coupling holes 114 and 115 for coupling of a member required for applying an input operation to the shaft 110 are formed in the exposed part of the shaft portion 111.

As illustrated in FIGS. 4 to 6, the magnetic disk 120 is disposed in the gap 80 between the first yoke 30 and the second yoke 40 and extends in the direction perpendicular to the center axis 11. Accordingly, the magnetic disk 120 is positioned to overlap with the excitation coil 50 when viewed in the direction along the center axis 11. Thus, the magnetic disk 120 overlaps with the outward-extending part of the circular ring portion 31 when viewed in plan. Here, the magnetic disk 120 and the excitation coil 50 are just required to be positioned such that they overlap with each other at least partly in the direction along the center axis 11. As illustrated in FIG. 6, the magnetic disk 120 has the upper surface 124 and the lower surface 125, namely two surfaces that are perpendicular to the first direction along the center axis 11 and that are opposite to each other. A gap 81 is present between the upper surface 124 of the magnetic disk 120 and the bottom surface 35 of the first yoke 30, and a gap 82 is present between the lower surface 125 of the magnetic disk 120 and the upper surface 41 of the second yoke 40. Moreover, the outer peripheral edge 126 of the magnetic disk 120 and the sidewall 75 of the third yoke 70 are spaced from each other by the presence of the magnetic gap G.

When the magnetic disk 120 is rotated relative to the first yoke 30 and the second yoke 40 with an operation of rotating the shaft 110, a distance between the upper surface 124 of the magnetic disk 120 and the bottom surface 35 of the first yoke 30 in the up-down direction is held substantially constant, a distance between the lower surface 125 of the magnetic disk 120 and the upper surface 41 of the second yoke 40 in the up-down direction is also held substantially constant, and a distance between the outer peripheral edge 126 of the magnetic disk 120 and the inner peripheral surface 71 of the sidewall 75 in the radial direction is further held substantially constant.

As illustrated in FIGS. 4 to 6, the magneto-rheological fluid 160 is filled in the gap 80 around the magnetic disk 120. Accordingly, the magneto-rheological fluid 160 is present not only in the gap 81 sandwiched between the upper surface 124 of the magnetic disk 120 and the bottom surface 35 of the first yoke 30 in the up-down direction, but also in the gap 82 sandwiched between the lower surface 125 of the magnetic disk 120 and the upper surface 41 of the second yoke 40 in the up-down direction. The magneto-rheological fluid 160 is further present in a space (magnetic gap G) sandwiched between the outer peripheral edge 126 of the magnetic disk 120 and the sidewall 75 of the third yoke 70 in the radial direction. The gap 80 around the magnetic disk 120 is sealed off by the shaft 110, the O-ring 116, the support member 140, the first yoke 30, the second yoke 40, the third yoke 70, the annular member 60, and so on. Hence the magneto-rheological fluid 160 is reliably held in the gap 80.

Here, the gap 80 may not need to be entirely filled with the magneto-rheological fluid 160. For example, the magneto-rheological fluid 160 may be present in only one of regions above the upper surface 124 and below the lower surface 125. The magneto-rheological fluid 160 may be filled into the gap 80 by injection or may be put into the gap 80 by coating the fluid over the upper surface 124 and the lower surface 125 of the magnetic disk 120, the bottom surface 35 of the circular ring portion 31, the upper surface 41 of the second yoke 40, the lower surface 61 of the annular member 60, the inner peripheral surface 71 of the third yoke 70, and so on.

The magneto-rheological fluid 160 is a substance of which viscosity changes with application of a magnetic field. The magneto-rheological fluid 160 is, for example, a fluid that is prepared by dispersing particles made of a magnetic material (namely, magnetic particles) into a non-magnetic liquid (namely, a solvent). For example, carbon-containing iron-based particles or ferrite particles are preferably used as the magnetic particles to be contained in the magneto-rheological fluid 160. The carbon content of the carbon-containing iron-based particles is preferably 0.15% or more, for example. A diameter of the magnetic particles is preferably 0.5 μm or greater and more preferably 1 μm or greater, for example. The solvent and the magnetic particles of the magneto-rheological fluid 160 are desirably selected such that the magnetic particles are hard to settle due to gravity. Moreover, the magneto-rheological fluid 160 desirably contains a coupling material to prevent the settlement of the magnetic particles.

As described above, when the current is applied to the excitation coil 50, the magnetic field is generated as illustrated in FIG. 4B such that the magnetic flux crosses the magnetic disk 120 only along the up-down direction and that, inside the magnetic disk 120, magnetic flux along the radial direction is not generated or its density is small even if generated. With the generated magnetic field, magnetic force lines extending along the radial direction are generated in the second yoke 40, and magnetic force lines extending along the up-down direction and opposing to the direction of the magnetic force lines in the magnetic disk 120 are generated in the sidewall 75 of the third yoke 70. Furthermore, magnetic force lines extending along the radial direction and opposing to the direction of the magnetic force lines in the second yoke 40 are generated in the upper wall 74 of the third yoke 70.

Looking at the magneto-rheological fluid 160, when the magnetic field is generated by applying the current to the excitation coil 50, the magnetic field along the up-down direction is given to the magneto-rheological fluid 160. By the action of the magnetic field, the magnetic particles dispersed in the magneto-rheological fluid 160 are gathered along the magnetic line forces and the magnetic particles arrayed in the up-down direction are magnetically intercoupled, thereby forming a cluster. When a force causing the shaft 110 to rotate about the center axis 11 is applied in the above-mentioned state, a shearing force acts on the intercoupled magnetic particles, whereupon those magnetic particles generate a resistance force (torque). It is, therefore, possible to make an operator feel a stronger resistance force than in a state in which the magnetic field is not generated.

On the other hand, when the excitation coil 50 does not generate the magnetic field, the magnetic particles are dispersed in the solvent without forming any cluster. Accordingly, when the operator operates the shaft 110, the operating unit 100 is rotated relative to the holder 20 without receiving a strong resistance force. In another case, when there is a residual magnetic field within the yoke in the state of the excitation coil 50 not being energized, a resistance torque remains in the shaft 110 depending on magnetic flux due to the residual magnetic field.

Because the magnetic disk 120 in the form of a circular plate extending outward from the shaft 110 in the radial direction is used as described above, the magneto-rheological fluid 160 can be arranged over a wider region than in the case of using only the shaft 110. Moreover, a magnitude of the resistance force caused by the magneto-rheological fluid 160 relates to a size of a region where the magneto-rheological fluid 160 is arranged, the region being sandwiched between the bottom surface 35 of the first yoke 30 and the upper surface 41 of the second yoke 40 in the up-down direction. In particular, the magnitude of the resistance force caused by the magneto-rheological fluid 160 when the magnetic disk 120 is rotated by operating the shaft 110 relates to an area of the magneto-rheological fluid 160, the area defining a plane that is perpendicular to a direction of the rotation. Hence, as the region where the magneto-rheological fluid 160 is arranged has a larger size, a wider control width of the resistance force (torque) can be obtained.

Structure of Magnetic Disk

Figure 7B:
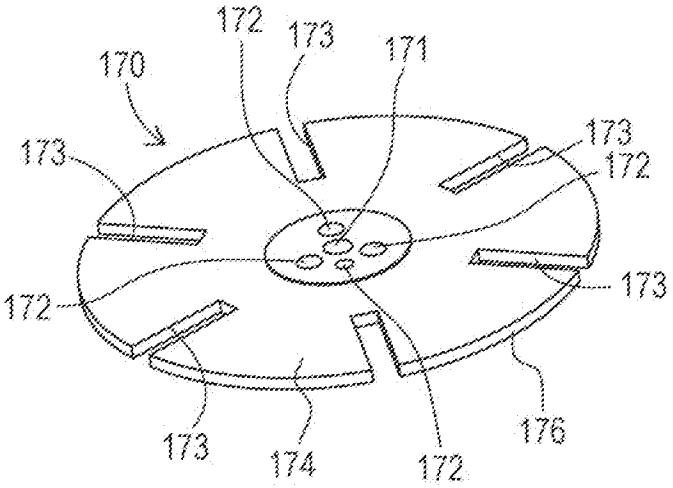
FIG. 7B is a perspective view of the magnetic disk of FIG. 7A.
Figure 7A:
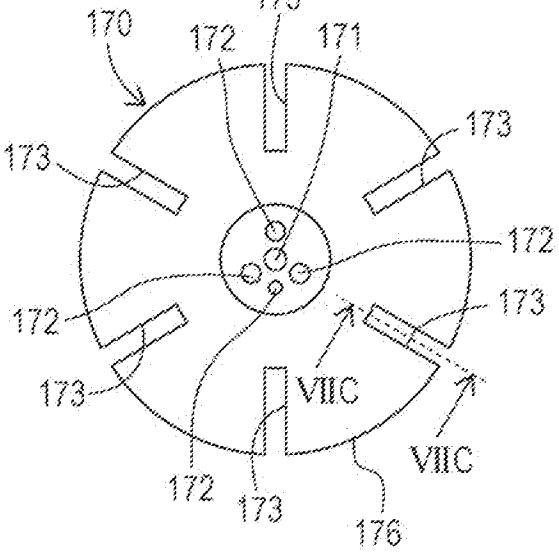
FIG. 7A is a plan view illustrating a structure of a magnetic disk in an embodiment.
Figure 7C:
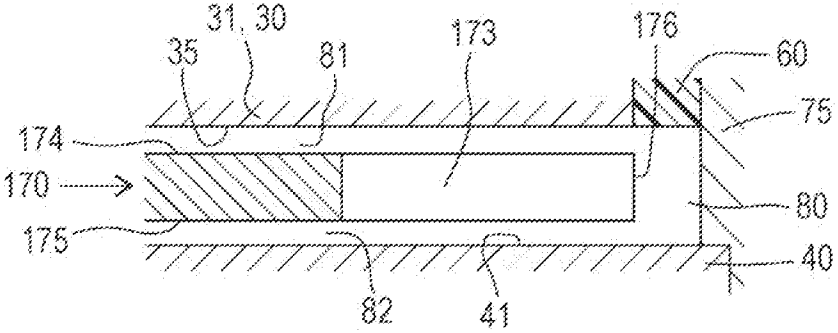
FIG. 7C is a sectional view taken along a line VIIC-VIIC in FIG. 7A.

FIG. 7A is a plan view illustrating a structure of the magnetic disk 170 (rotor) in the embodiment, FIG. 7B is a perspective view of the magnetic disk 170 of FIG. 7A, and FIG. 7C is a sectional view taken along a line VIIC-VIIC in FIG. 7A, the view further illustrating the circular ring portion 31, the second yoke 40, and the annular member 60 around the magnetic disk 170 as well.

As illustrated in FIGS. 7A and 7B, like the above-described magnetic disk 120, the magnetic disk 170 is a member in the form of a circular plate made of a magnetic material and having a circular flat surface (each of an upper surface 174 and a lower surface 175) that is entirely arranged perpendicular to the up-down direction (direction vertical to the drawing sheet of FIG. 7A). Furthermore, as in the magnetic disk 120, a center hole 171 vertically penetrating through the magnetic disk 170 is formed at a center of the circular flat surface, and multiple through-holes 172 vertically penetrating through the magnetic disk 170 are formed at positions around the center hole 171.

Instead of forming the center holes 121 and 171 in the magnetic disks 120 and 170, respectively, the magnetic disks 120 and 170 may be fixed to the shaft 110 by welding.

In addition, the magnetic disk 170 includes six cutouts 173 formed to extend in the radial direction going from the center of the circular flat surface toward an outer peripheral edge 176. Those cutouts 173 are arranged as torque increasing portions in an outer peripheral region in the second direction, namely the radial direction, at equal angular intervals about the center of the circular flat surface, and they are formed to penetrate through the magnetic disk 170 in the up-down direction (thickness direction of the magnetic disk 170). Thus, the cutouts 173 are formed as elongate openings of which lengthwise direction is the second direction.

The cutouts 173 may be formed at the same time as manufacturing the circular plate member that becomes the magnetic disk 170. Alternatively, after manufacturing the circular plate member, the cutouts 173 may be formed by laser machining, etching, or the like. Moreover, the six cutouts 173 are formed to have the same length in the radial direction of the circular flat surface and the same width in the circumferential direction thereof. Here, the above-mentioned outer peripheral region is a region of the magnetic disk 170 including an outer side in the radial direction (second direction) and includes a region that is defined by projecting the excitation coil 50 in the direction of the center axis 11.

Although the cutouts 173 have been described as vertically penetrating through the magnetic disk 170, the cutouts 173 may be formed as bottom-equipped recesses without penetrating through the magnetic disk 170. In such a case, the recesses may be formed in either one of the upper surface 174 and the lower surface 175 of the magnetic disk 170, or may be formed in both the surfaces.

Control Unit and Control Method

Figure 8:
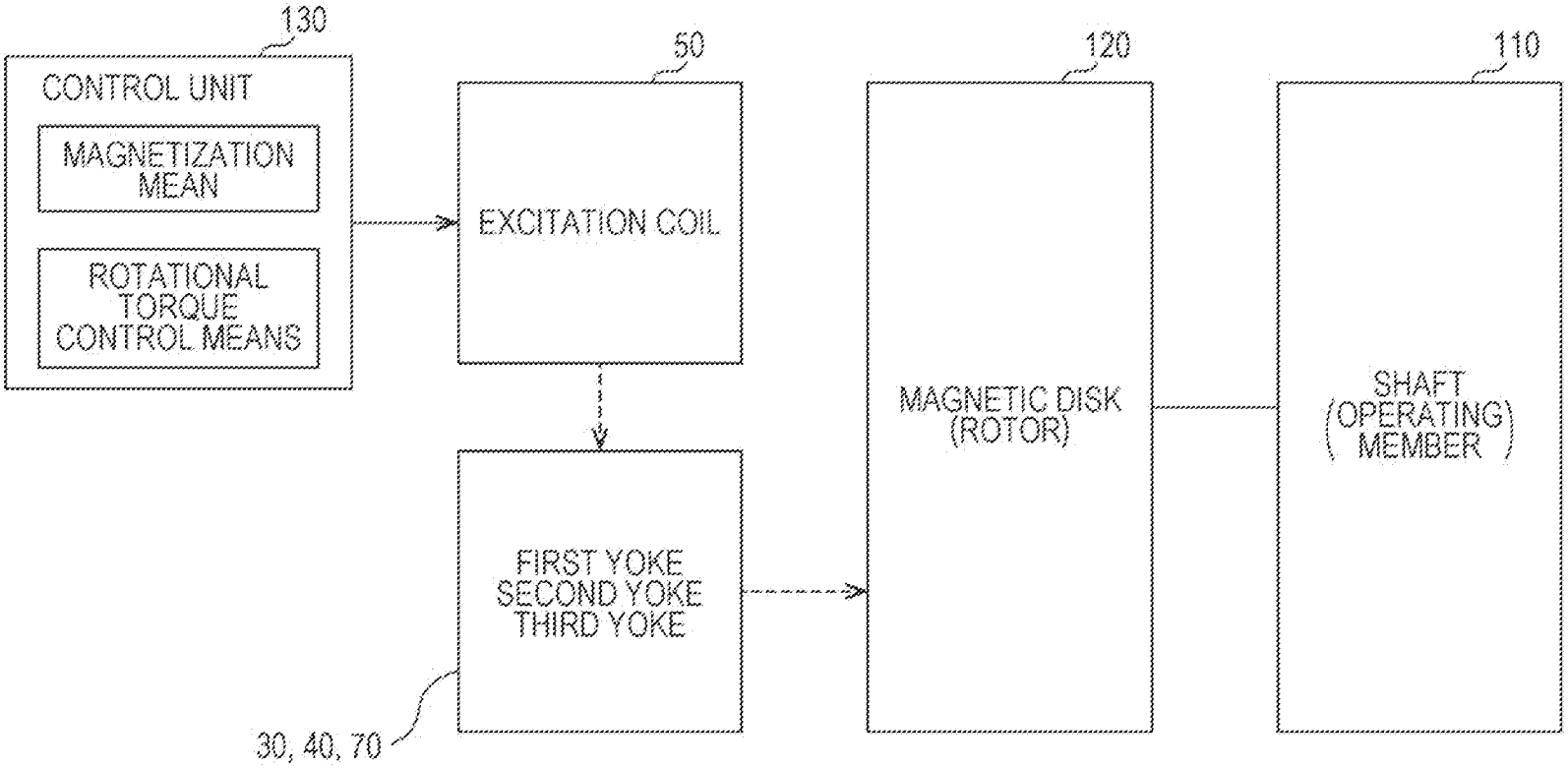
FIG. 8 is a functional block diagram of the operating device illustrated in FIGS. 1A and 1B.

FIG. 8 is a functional block diagram of the operating device 10. The operating device 10 includes the above-described excitation coil 50 and a control unit 130 connected to the excitation coil 50 through the connection member 51. The control unit 130 controls the magnetic flux generated by the excitation coil 50 and the magnetic path for the generated magnetic flux by controlling a current value applied to the excitation coil 50. Thus, the magnetic flux passing through the magneto-rheological fluid 160 and the magnetic disk 170 (or the magnetic disk 120) is controlled. By the action of the controlled magnetic flux, the magnetic particles dispersed in the magneto-rheological fluid 160 are gathered along the magnetic line forces and the magnetic particles arrayed in the up-down direction are magnetically intercoupled, thereby forming a cluster. When a force causing the shaft 110 to rotate about the center axis 11 is applied in the above-mentioned state, a shearing force acts on the intercoupled magnetic particles, whereupon those magnetic particles generate a resistance force (torque). It is, therefore, possible to control the resistance force felt by the operator operating the shaft 110.

Furthermore, the control unit 130 functioning as magnetization means supplies a current to energize the excitation coil 50 such that a residual magnetic field in each of the first yoke 30, the second yoke 40, and the third yoke 70 is held at a predetermined magnitude (magnetic flux density). In the magnetic disk 170, residual magnetic flux passing through the magnetic disk 170 is produced in accordance with residual magnetic fields generated depending on hysteresis characteristics of the first yoke 30, the second yoke 40, and the third yoke 70. A coil dedicated for the magnetization means may be disposed separately from the excitation coil 50 or may be provided by dividing the excitation coil 50.

Moreover, the control unit 130 functioning as rotational torque control means adjusts a current value applied to the excitation coil 50 in accordance with a magnitude of the residual magnetic fields in the first yoke 30, the second yoke 40, and the third yoke 70. A maximum value (absolute value) of the current value applied in the above adjustment is set to be smaller than an absolute value of a current value applied when the control unit 130 functions as the magnetization means.

In the following description, the residual magnetic flux passing through the magneto-rheological fluid 160 and the magnetic disk 170 (or the magnetic disk 120) is called the residual magnetic flux passing through the magnetic disk 120.

Figure 9:
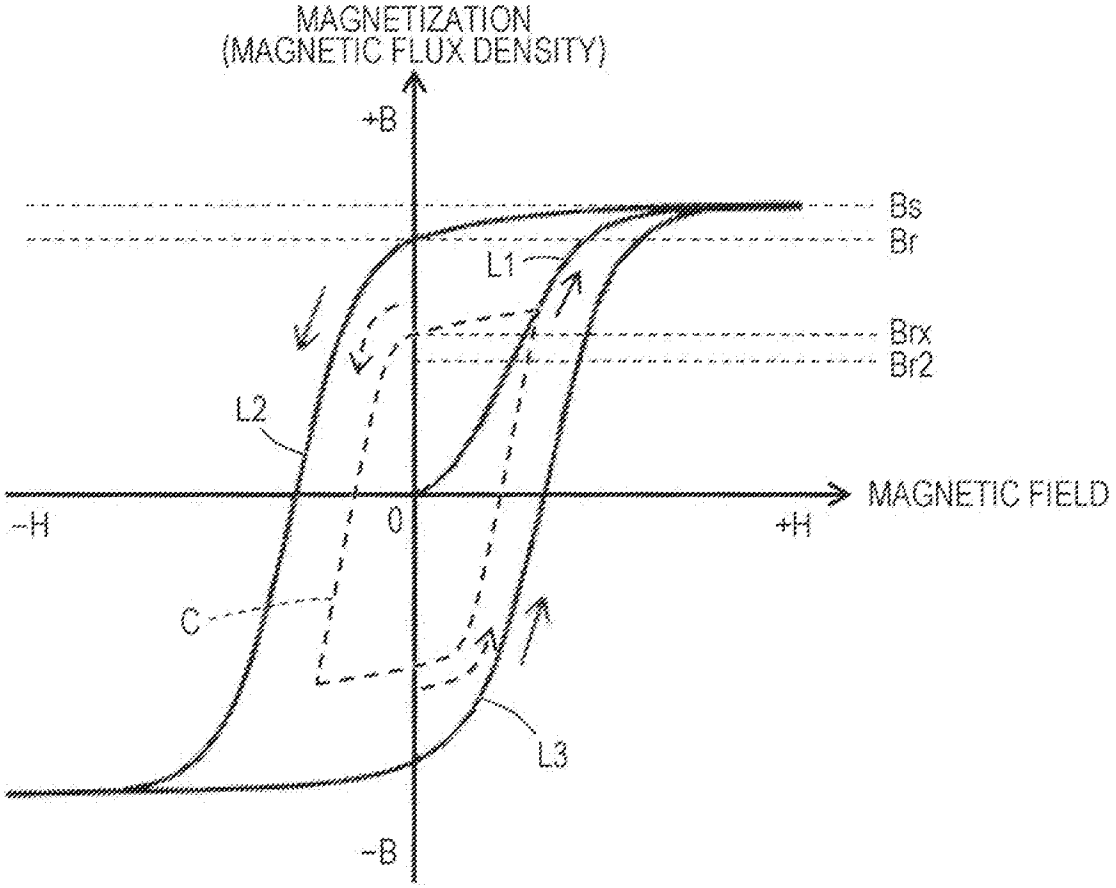
FIG. 9 is a graph representing a hysteresis curve of a magnetic body.

FIG. 9 is a graph representing a hysteresis curve of a magnetic body with a horizontal axis indicating a magnetic field and a vertical axis indicating magnetization (magnetic flux density) of the magnetic body placed in the magnetic field. Assuming that, in this embodiment, the first yoke 30, the second yoke 40, and the third yoke 70 are made of the same type of magnetic body, for example, soft iron, when the excitation coil 50 generates the magnetic field indicated by the horizontal axis of FIG. 9, each of the first yoke 30, the second yoke 40, and the third yoke 70 causes change of the magnetization (magnetic flux density) as represented by the curve in FIG. 9, and a residual magnetic field is generated depending on the hysteresis characteristic. The residual magnetic flux passing through the magnetic disk 120 is produced in accordance with the generated residual magnetic field.

Figure 10:
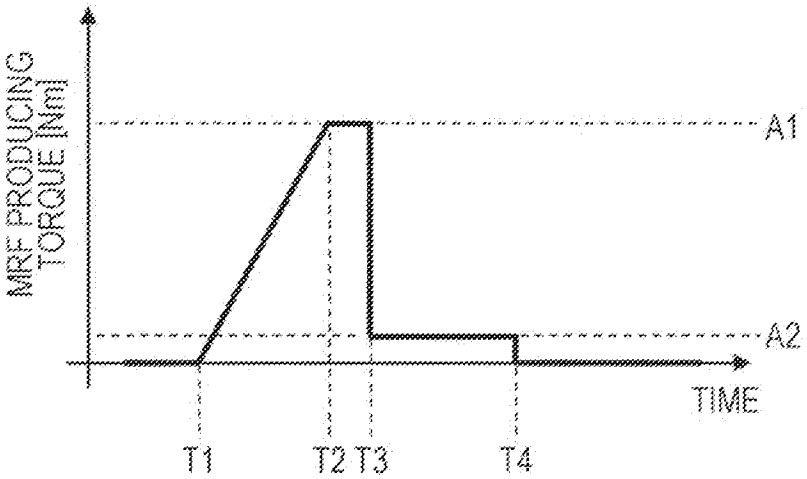
FIG. 10 is a graph representing change of a MRF producing torque when magnetization and an offset are controlled by magnetization means.
Figure 11:
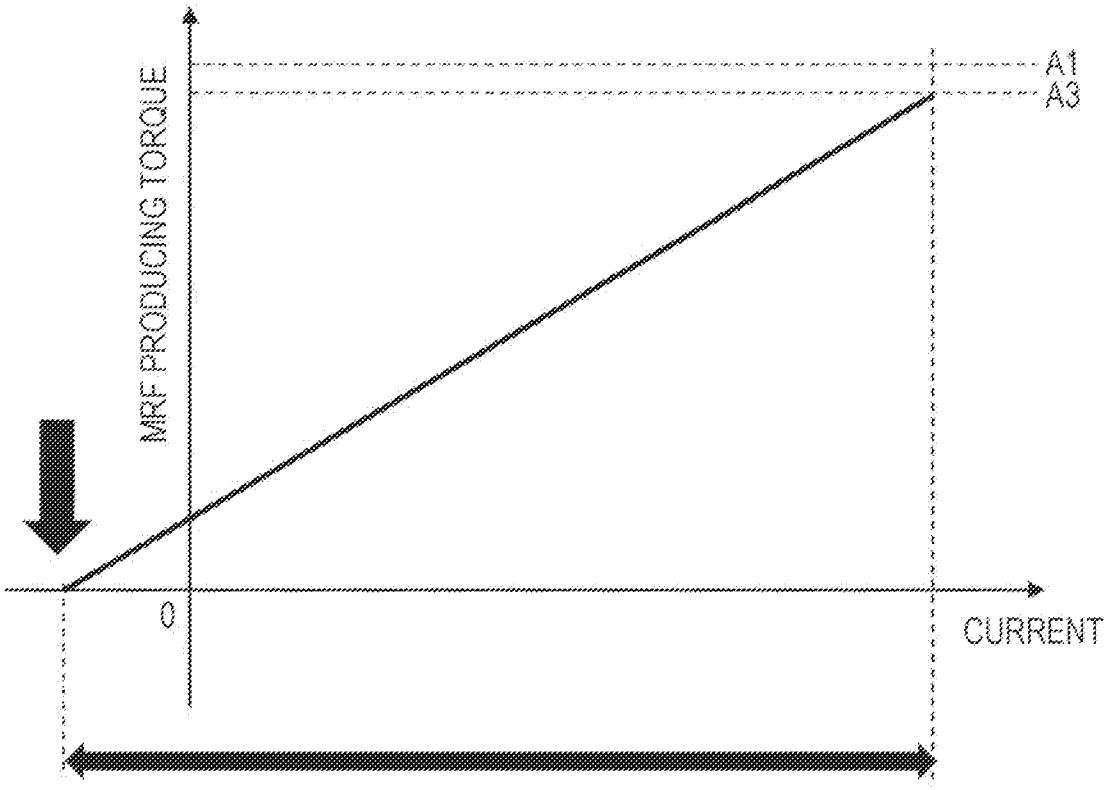
FIG. 11 is a graph representing relation between a current applied to a coil and the MRF producing torque after the magnetization has come into a saturated state.

FIGS. 9 to 11 are each a graph conceptually representing the magnetization (magnetic flux density) or torque.

As illustrated in FIG. 9, when the magnetic field is gradually strengthened from zero, the magnetization reaches a saturated state (saturated magnetization) (curve L1 (solid line)), and the magnetic flux density in the magnetic body becomes a saturated magnetic flux density Bs. Most of the magnetization (magnetic flux density) upon reaching the saturation remains even when the magnetic field after the saturation is gradually reduced toward zero, and the magnitude of the residual magnetic field (residual magnetic flux density) in the yoke becomes Br (curve L2 (solid line)). In this embodiment, the control unit 130 functioning as the magnetization means preferably applies the current to the excitation coil 50 until all the first yoke 30, the second yoke 40, and the third yoke 70 come into the saturated state. Thus, since the magnetization in the first yoke 30, the second yoke 40, and the third yoke 70 reaches the saturated state, the residual magnetic fields in the first yoke 30, the second yoke 40, and the third yoke 70 are set to a predetermined magnitude (saturated residual magnetization) (magnetization step in a control method for the operating device).

Here, the residual magnetic field of the predetermined magnitude applied in the magnetization step is not limited to the saturated residual magnetization. In more detail, the residual magnetic field (magnetic flux density) of the predetermined magnitude is preferably set to be greater than the magnetic field in a range (usage range) that is set for the first yoke 30, the second yoke 40, and the third yoke 70 in the operation of the operating device 10 after the magnetization step. The usage range is set by performing a simulation based on the structure of the operating device 10, or by previously measuring, with an external measuring device, for example, the magnetization of each yoke when the operating device 10 is operated. In the case in which the residual magnetic field of the predetermined magnitude is not the saturated residual magnetization, if a maximum value of the magnetic field in the usage range is Br2 as illustrated in FIG. 9, for example, it is preferable that the residual magnetic field (residual magnetic flux density) is set to a value Brx greater than Br2 and a current is applied to the excitation coil 50 to obtain a hysteresis curve C drawn with a dotted line in FIG. 9.

By, as described above, setting the residual magnetic field (residual magnetic flux density) of the predetermined magnitude in the magnetization step and by adjusting the current value applied to the excitation coil 50 in accordance with the magnitude of the residual magnetic fields in the first yoke 30, the second yoke 40, and the third yoke 70 in a rotational torque control step (described later), the magnetic flux passing through the magnetic disk 120 (or the magnetic disk 170) is reduced, whereby the MRF producing torque (the resistance force perceived by the operator) that is produced by the MRF at the start of the operation can be reduced.

The magnetization by the magnetization means (namely, the magnetization step) is executed each time the operating device 10 is started up. The saturated magnetization is hard to reduce even after weakening the magnetic field in which the magnetic body (the first yoke 30, the second yoke 40, and the third yoke 70) is placed. From the viewpoint of more reliably stabilizing the initial torque, however, the saturated magnetization is preferably further executed at suitable timing other than the startup and may be executed with a manual operation by the operator. Moreover, the magnetization by the magnetization means may be executed when a current is applied to realize an end stop state. In such a case, since a strong brake force is applied to the shaft 110, it is possible to give the operator an operation feel (so-called end stop) as if an operation target is stopped upon striking against an imaginary wall.

On the other hand, the control unit 130 functioning as the rotational torque control means adjusts the current value applied to the excitation coil 50 in accordance with the magnitude of the residual magnetic fields in the first yoke 30, the second yoke 40, and the third yoke 70 (rotational torque control step), which have been generated in the magnetization step. The maximum value (absolute value) of the current value applied to the excitation coil 50 by the rotational torque control means (namely, the current value corresponding to a MRF producing torque A3 in FIG. 11) is set to be smaller than the absolute value of the current value applied in the magnetization step (namely, the current value corresponding to a MRF producing torque A1 in FIG. 10). Here, the MRF producing torque A3 is smaller than the MRF producing torque A1.

Figure 12:
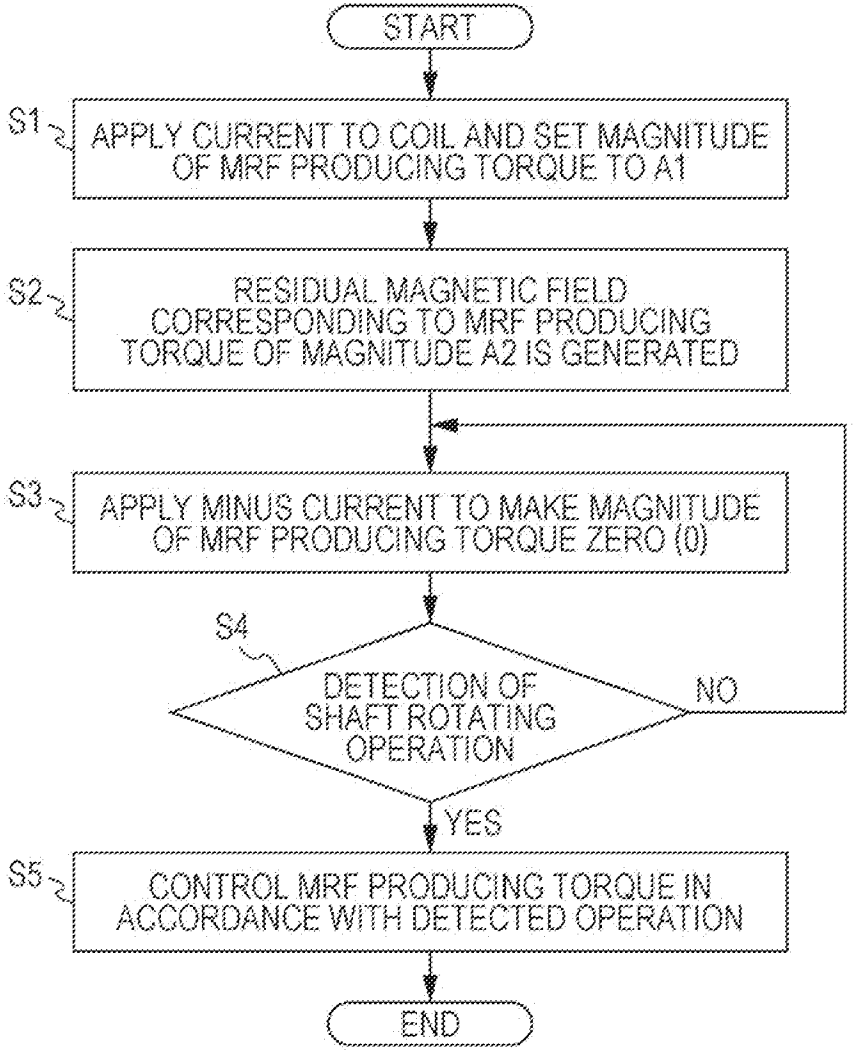
FIG. 12 is a flowchart representing an example of a flow of processing executed in the operating device according to the embodiment.

As described above, the magnetization step and the rotational torque control step are executed in the control method for the operating device 10. FIG. 12 is a flowchart representing an example of a flow of processing executed in the operating device 10.

Magnetization Step (Steps S1 and S2 in FIG. 12)

In the magnetization step, the excitation coil 50 is energized to set the residual magnetic fields in the first yoke 30, the second yoke 40, and the third yoke 70 to the predetermined magnitude. Thus, the magnetization (magnetic flux density) having been zero at the startup of the operating device 10 (at the start of the curve L1 in FIG. 9, time T1 in FIG. 10) increases with the lapse of energization time. On that occasion, the resistance force (MRF producing torque) (vertical axis in FIG. 10) caused by the magneto-rheological fluid 160 also increases with an increase of the magnetic field generated by the excitation coil 50.

After the lapse of a certain time from the start of the energization in the magnetization step, the magnetization of the first yoke 30, the second yoke 40, and the third yoke 70 comes into the saturated state. At that time, namely at time T2 in FIG. 10, the resistance force (MRF producing torque) caused by the magneto-rheological fluid 160 reaches A1 and the magnetic flux density in the first yoke 30, the second yoke 40, and the third yoke 70 becomes the saturated magnetic flux density Bs (FIG. 9) (step S1 in FIG. 12).

When the energization of the excitation coil 50 is stopped at time T3 upon reaching the above-described saturated state, the residual magnetic fields are generated in the first yoke 30, the second yoke 40, and the third yoke 70 as represented in a region in which the magnetic field (horizontal axis) is positive along the curve L2 in FIG. 9. A period until the generation of the residual magnetic fields corresponds to a period from time T3 to T4 in FIG. 10, and the resistance force (MRF producing torque) caused by the magneto-rheological fluid 160 is held constant at A2. In the first yoke 30, the second yoke 40, and the third yoke 70, the residual magnetic fields corresponding to the MRF producing torque A2 are generated (step S2 in FIG. 12).

Rotational Torque Control Step (Steps S3 to S5 in FIG. 12)

Figure 13:
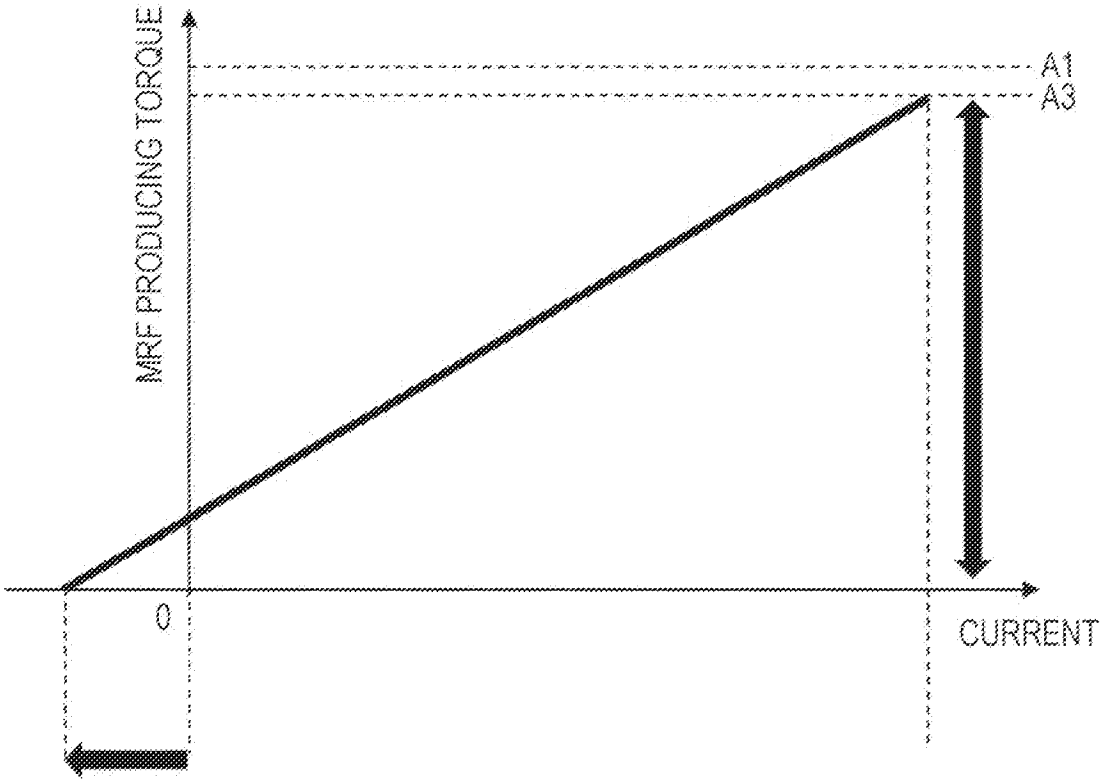
FIG. 13 is a graph representing relation between the current applied to the excitation coil and the MRF producing torque in a rotational torque control step.
Figure 14:
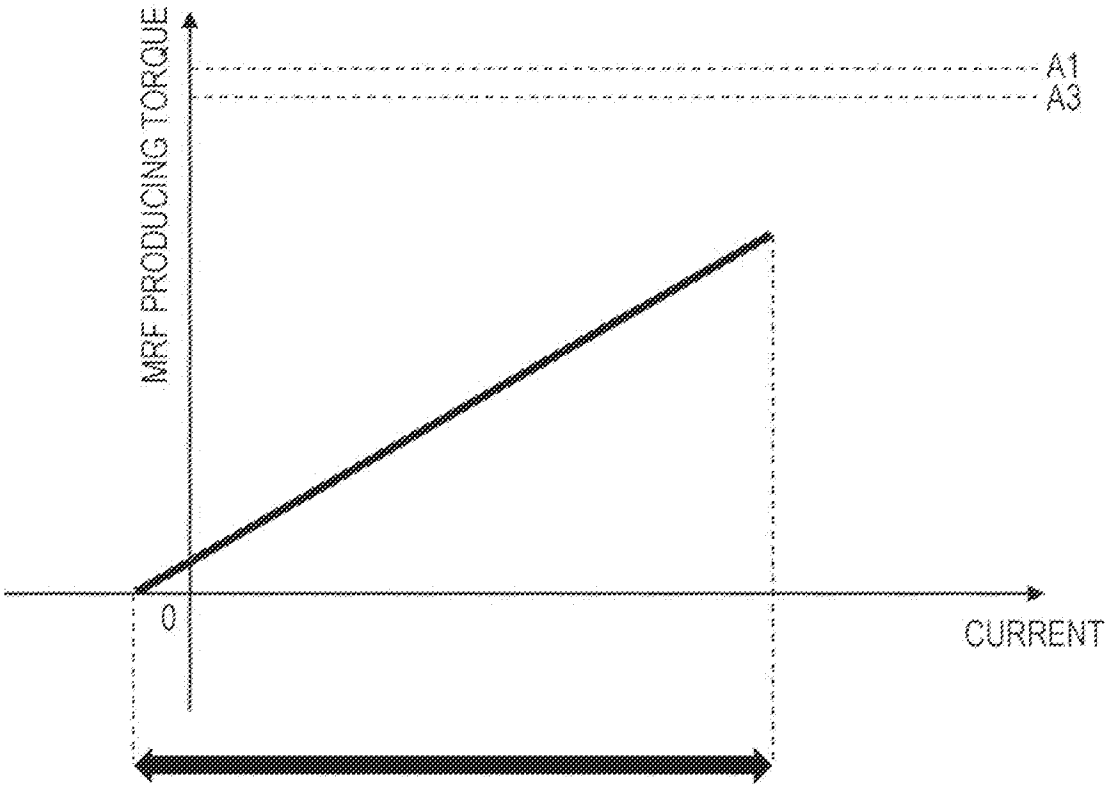
FIG. 14 is a graph representing relation between the current applied to the excitation coil and the MRF producing torque in the rotational torque control step.
Figure 15:
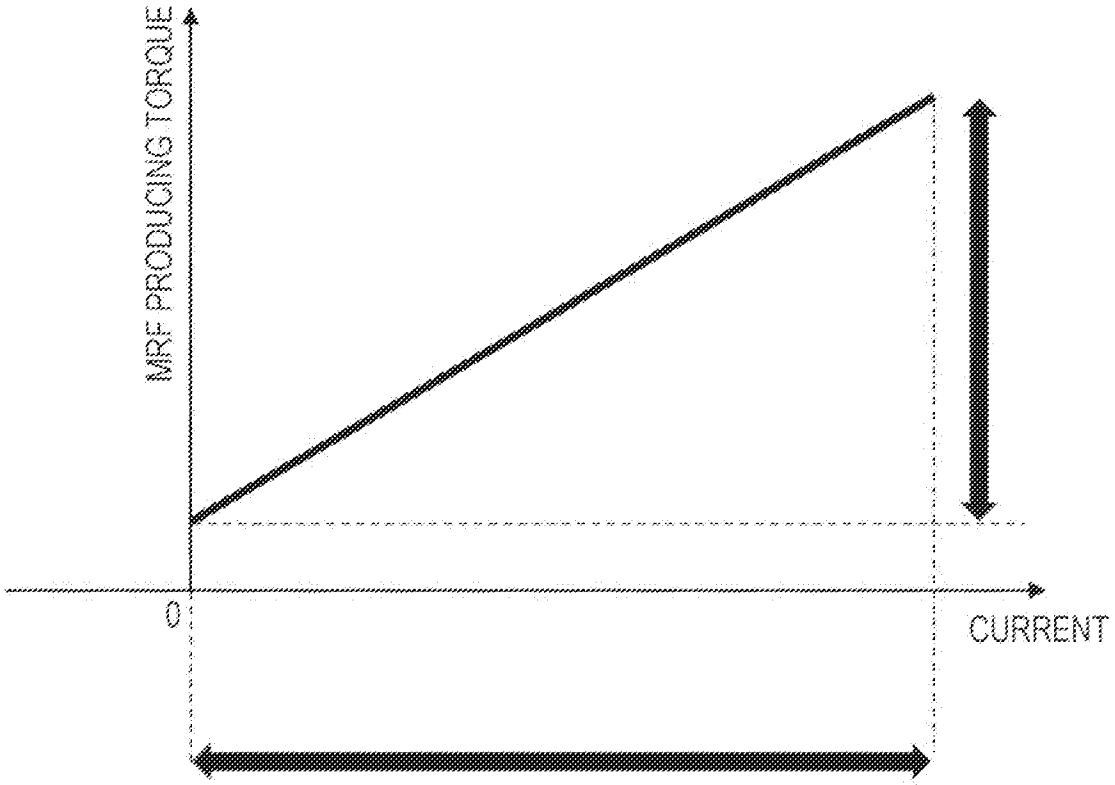
FIG. 15 is a graph representing relation between a current applied to a coil and a MRF producing torque in feedback control executed by a related-art operating device.

FIGS. 13 and 14 are each a graph representing relation between the current applied to the excitation coil 50 and the MRF producing torque in the rotational torque control step. FIG. 15 is a graph representing relation between a current applied to a coil and a MRF producing torque in feedback control executed by a related-art operating device. An example illustrated in FIG. 13 represents the case in which the residual magnetic fields in the first yoke 30, the second yoke 40, and the third yoke 70 have the same magnitude as that of the saturated residual magnetization. An example illustrated in FIG. 14 represents the case in which each yoke is not completely saturated, namely the case in which the residual magnetic field of the predetermined magnitude is smaller than that of the saturated residual magnetization. In this case, the MRF producing torque corresponding to the maximum value (absolute value) of the current value applied to the excitation coil 50 is smaller than the MRF producing torque A3 corresponding to the maximum value (absolute value) of the current value applied to the excitation coil 50 in the example illustrated in FIG. 13.

In the rotational torque control step, the current value applied to the excitation coil 50 is adjusted in accordance with the magnitude of the residual magnetic fields in the first yoke 30, the second yoke 40, and the third yoke 70 (step S3 in FIG. 12), which has been set to the predetermined magnitude in the magnetization step. In the example illustrated in FIG. 10, the rotational torque control step is executed at the time T4, whereby the resistance force (MRF producing torque) caused by the magneto-rheological fluid 160 is reduced from A2 to zero. In the control step, the current value applied to the excitation coil 50 is set to a minus value with an offset in accordance with the magnitude of the residual magnetic fields (residual magnetic flux density) in the first yoke 30, the second yoke 40, and the third yoke 70, and the magnetic flux passing through the magnetic disk 120 is reduced to zero.

The current applied to the excitation coil 50 in the rotational torque control step when reducing the resistance force (MRF producing torque) from A3 is given as illustrated in FIG. 11, 13 or 14, and the resistance force (MRF producing torque) is reduced substantially in proportion to the change of the current value. As a result, a constant torque can be obtained as the torque produced at the start of the operation.

As illustrated in FIGS. 11, 13 and 14, even when the initial torque (the MRF producing torque when the current value is zero) is greater than zero, the MRF producing torque can be reduced to zero by applying a minus current to the excitation coil 50 (step S3 in FIG. 12). Here, in the example illustrated in FIG. 14, since the yoke is not completely saturated in the magnetization step, an absolute value of the minus current for reducing the MRF producing torque to zero can be reduced.

On the other hand, in the related-art operating device, the resistance force can also be reduced by applying, as illustrated in FIG. 15, a current to a coil that corresponds to the excitation coil 50 in this embodiment. However, there has been a difficulty in reducing the MRF producing torque to zero or in adjusting it to a desired magnitude due to, for example, factors (1) to (3) mentioned below. Hence a dynamic range specified based on a minimum torque and a maximum torque is apparently smaller than that in each of the cases illustrated in FIGS. 11, 13 and 14.

(1) The initial torque when the coil is not energized is not zero, or a variation of the initial torque is large.

(2) The residual magnetic field is generated in the yoke material depending on history of the energization.

(3) The torque is produced due to the magneto-rheological fluid 160 and sliding members.

In the rotational torque control step in this embodiment, when the operation of rotating the shaft 110 is detected after step S3 in FIG. 12 (YES in step S4 in FIG. 12), the current amount applied to the excitation coil 50 is adjusted in accordance with the detected operation. With the above adjustment, the MRF producing torque can be controlled such that the MRF producing torque at the start of the operation can be stably held at a certain value (step S5).

By executing the magnetization step and the rotational torque control step as described above, the rotational torque can be simply and accurately controlled, and the initial torque can be set to the desired constant value. In particular, since the current value required to be applied to reach the saturated magnetization and the minus current required to be applied in the rotational torque control step for making the influence of the residual magnetic field zero can be previously set in accordance with the constituent materials of the first yoke 30, the second yoke 40, and the third yoke 70, the desired initial torque can be easily and reliably set without detecting the actual magnetic field and magnetization (magnetic flux density) and performing feedback control. Furthermore, because of no necessity of disposing sensors or the likes necessary for the feedback control, it is possible to suppress an increase of the parts cost, to reduce limitations on layout of the individual members, and to prevent an increase of the device size. In addition, because of no necessity of adding a circuit and so on for the feedback control, the cost of manufacturing or design can be suppressed.

On the other hand, the following problems arise in the operating device not including the magnetization means and the rotational torque control means. When the energization of the excitation coil 50 is stopped after energizing the excitation coil 50 as in the magnetization step, a residual magnetic field is generated in each yoke in accordance with the magnetic field that has been generated before the stop of the energization. Even in the state in which no current is applied to the excitation coil 50, the magnetic flux (residual magnetic flux) is given to the magneto-rheological fluid 160 depending on a magnitude of the residual magnetic field in each yoke. That residual magnetic flux becomes a source of producing a torque on the shaft 110 and hence acts as a factor varying the initial torque in subsequence use of the device. The initial torque can be reduced by, with intent to suppress such a variation of the initial torque, measuring the residual magnetic flux with a magnetic sensor and generating, from the excitation coil 50, a magnetic field to cancel the residual magnetic flux, but this solution increases the number of components. Instead of performing the measurement with the magnetic sensor, it is also conceivable to apply, to the excitation coil 50, a current in the form of a gradually attenuating sine wave in match with a degaussing (demagnetizing) profile. However, this solution accompanies with a problem of taking a lot of time due to the necessity of setting a reaction time in consideration of the coil time constant.

In contrast, in the operating device 10 according to this embodiment, after applying the current to the excitation coil 50 in the magnetization step, the energization of the excitation coil 50 is stopped to generate the residual magnetic field (residual magnetic flux density) of the predetermined magnitude in the yoke. With that control, the magnitude of the residual magnetic flux given to the magneto-rheological fluid 160 can be held constant. Under the condition that the magnitude of the residual magnetic flux given to the magneto-rheological fluid 160 is constant, the magnetic flux passing through the magnetic disk 120 can be controlled by controlling, with the current applied to the excitation coil 50, the magnetic field given to the yoke without measuring the residual magnetic flux.

Modifications will be described below.

While, in the rotational torque control step in the above-described embodiment, the resistance force is reduced to be smaller than the initial torque by applying the minus current to the excitation coil 50 to make the resistance force in the magneto-rheological fluid 160 zero, the resistance force may not need to be reduced to zero. For example, a certain operation feel can be given to the operator by setting the MRF producing torque at the start of the operation by the operator to a desired resistance force that is close to zero.

Furthermore, when the operator does not operate the operating device immediately after the magnetization step, the MRF producing torque may be kept the same as the initial torque without executing the rotational torque control step such that the operation feel remains relatively heavy. In such a case, the MRF producing torque can be reduced to zero by executing the rotational torque control step and by applying the minus current when the start of the operation by the operator is detected.

While the present invention has been described with reference to the foregoing embodiment, the present invention is not limited to the foregoing embodiment and can be improved or modified with intent to improve the invention within the scope of the concept of the present invention.

As described above, the operating device according to the present invention enables the desired constant initial torque to be obtained while suppressing the cost related to control.

What is claimed is:

1. An operating device comprising:

an operating member rotatably supported by a case;

a rotor rotating together with the operating member;

a magnetic field generator configured to generate a magnetic field passing through the rotor, the magnetic field generator including a coil generating the magnetic field and a yoke forming a magnetic path for the magnetic field passing through the rotor;

a magneto-rheological fluid disposed in contact with the rotor and giving a resistance force to the rotation of the rotor due to the magnetic field passing through the magnetic path; and a controller configured to control the magnetic field generator, the controller being further configured to:

supply a first current to the coil so as to generate a first magnetic field in the yoke via the magneto-rheological fluid, the first magnetic field having a first value;

terminate the supply of the first current to hold a residual magnetic field in the yoke, the residual magnetic field having a predetermined value; and supply a second current to the coil to generate a second magnetic field in the yoke so as to offset the residual magnetic field after the controller terminates the supply of the first current, an absolute value of a second value of the second magnetic field being the same as an absolute value of the predetermined value, the predetermined value being smaller than the first value, wherein the controller is configured to set a rotational torque of the operating member as an initial rotational torque when the controller supplies the second current to the coil, and the controller is configured to maintain the initial rotational torque of the operating member when the operating member is operated by an operator.

2. The operating device according to claim 1, wherein, when the first magnetic field is generated in the yoke, the yoke is in a saturated state, and a saturated residual magnetic field is held in the yoke by the termination of the supply of the first current, and the predetermined value of the residual magnetic field in the yoke corresponds to a value of the saturated residual magnetic field in the yoke.

3. The operating device according to claim 1, wherein the controller is configured to supply the first current to the coil when the operating device is started up.

4. The operating device according to claim 1, wherein the controller is configured to control a minimum rotational torque of the operating member to come close to zero by offsetting the residual magnetic field with the second magnetic field in the yoke such that magnetic flux passing through the rotor becomes zero.

5. A control method for an operating device, the operating device including:

an operating member rotatably supported by a case;

a rotor rotating together with the operating member;

a magnetic field generator configured to generate a magnetic field passing through the rotor, the magnetic field generator including a coil generating the magnetic field and a yoke forming a magnetic path for the magnetic field passing through the rotor; and a magneto-rheological fluid disposed in contact with the rotor and giving a resistance force to the rotation of the rotor due to the magnetic field passing through the rotor, the control method comprising:

supplying a first current to the coil so as to generate a first magnetic field in the yoke via the magneto-rheological fluid, the first magnetic field having a first value;

terminating the supply of the first current to hold a residual magnetic field in the yoke, the residual magnetic field having a predetermined value; and supplying a second current to the coil to generate a second magnetic field in the yoke so as to offset the residual magnetic field after the supply of the first current is terminated, an absolute value of a second value of the second magnetic field being the same as an absolute value of the predetermined value, the predetermined value being smaller than the first value, wherein a rotational torque of the operating member is set as an initial rotational torque when the second current is supplied to the coil, and the initial rotational torque of the operating member is maintained when the operating member is operated by an operator.

* * * * *